US007438584B2

(12) United States Patent
Caveney et al.

(10) Patent No.: US 7,438,584 B2
(45) Date of Patent: Oct. 21, 2008

(54) PLUG LOCKING ASSEMBLY

(75) Inventors: Jack E. Caveney, Hinsdale, IL (US); Shaun P Brouwer, St. John, IN (US)

(73) Assignee: Panduit Corp., Tinley Park, IL (US)

( * ) Notice: Subject to any disclaimer, the term of this patent is extended or adjusted under 35 U.S.C. 154(b) by 0 days.

(21) Appl. No.: 12/031,810

(22) Filed: Feb. 15, 2008

(65) Prior Publication Data

US 2008/0146056 A1 Jun. 19, 2008

Related U.S. Application Data

(63) Continuation of application No. 11/679,610, filed on Feb. 27, 2007, now Pat. No. 7,354,291.

(60) Provisional application No. 60/777,892, filed on Mar. 1, 2006, provisional application No. 60/821,017, filed on Aug. 1, 2006.

(51) Int. Cl.
*H01R 4/50* (2006.01)

(52) U.S. Cl. ..... 439/344; 439/352; 439/373

(58) Field of Classification Search ..... 439/133, 439/134, 304, 344, 352–358, 373, 676
See application file for complete search history.

(56) References Cited

U.S. PATENT DOCUMENTS 4,647,726 A 3/1987 Blum
4,846,708 A 7/1989 Marson et al.
4,911,646 A 3/1990 Marson et al.
4,946,404 A 8/1990 Takenouchi et al.
5,030,127 A 7/1991 Blasko et al.
5,120,255 A 6/1992 Kouda et al.
5,330,369 A 7/1994 Nozaki et al.
5,340,324 A 8/1994 Fields et al.
5,429,522 A 7/1995 Noschese et al.
5,507,666 A 4/1996 Yamanashi
5,556,295 A 9/1996 McFadden et al.
5,879,180 A 3/1999 Iwahori et al.
6,261,116 B1 7/2001 Ceru
6,290,539 B1 9/2001 Wilber et al.
6,918,782 B2 7/2005 Foster
2006/0040564 A1 2/2006 Morrison et al.

FOREIGN PATENT DOCUMENTS

WO 02075859 A1 9/2002

*Primary Examiner*—Khiem Nguyen
(74) *Attorney, Agent, or Firm*—Robert A. McCann; Christopher S. Clancy

(57) ABSTRACT

A plug locking assembly comprises a housing comprising a top surface, a bottom surface and opposing sidewalls defining an open space therebetween, the open space for receiving and carrying a plug comprising a spring member. The plug locking assembly is adapted to prevent unwanted access to modular plugs engaged in associated jacks. In one embodiment, the plug locking assembly comprises a plug protection member comprising a surface spaced apart from the open space and positioned to overlie at least a portion of the spring member with the plug engaged within the housing. The plug locking assembly may further comprise a locking clip releasably securable within the housing.

8 Claims, 20 Drawing Sheets

PLUG LOCKING ASSEMBLY

CROSS-REFERENCE TO RELATED APPLICATIONS

This application is a continuation of U.S. application Ser. No. 11/679,610, filed Feb. 27, 2007, which claims the benefit of U.S. Provisional Application Ser. No. 60/777.892, filed Mar. 1, 2006 and U.S. Provisional Application Ser. No. 60/821,017, filed Aug. 1, 2006, the subject matter of which is incorporated by reference in its entirety.

FIELD OF INVENTION

The present invention relates to a plug locking assembly and, more particularly, to a plug locking assembly for preventing unwanted access to a plug positioned within an associated jack.

BACKGROUND

Modern telecommunication and data processing equipment often includes modular plugs that engage jacks or receptacles to create electrical connections. Typical modular plugs include an integral resilient spring or latch mechanism for releasably securing the plug within the jack. In most cases, the springs or latches comprise a tab that projects out of the receptacle after insertion. Because these tabs are readily accessible by fingernails and/or small tools, the unauthorized removal of modular plugs from their corresponding jacks is a common problem.

There is a need, therefore, for a plug locking assembly that protects modular plugs and prevents their unintended disconnection from associated jacks.

SUMMARY OF THE INVENTION

The present invention relates to in improved plug locking assembly.

In one embodiment, the plug locking assembly comprises a housing comprising a top portion, a bottom portion and opposing sidewalls defining, an open space therebetween, the open space for receiving and carrying a plug comprising a spring. The open space is dimensioned such that at least a portion of the spring extends beyond the open space with the plug engaged within the housing. The plug locking assembly of this embodiment further comprises a plug protection member connected to the housing. The plug protection member comprises a surface spaced apart from the open space and positioned to overlie at least a portion of the spring with the plug engaged within the housing.

In another embodiment, the plug locking assembly comprises a housings, locking clip and an angled surface formed on at least one of the locking clip and the housing. The housing comprises a top portion, a bottom portion and opposing sidewalls defining an open space therebetween. The open space is designed to receive and carry a plug comprising a cantilevered spring with a fixed end and a free end. The locking clip is releasably securable to the housing. The angled surface is positioned to overlie and retain the free end of the cantilevered spring with the plug engaged within the housing.

In yet another embodiment, the plug locking assembly comprises a housing and a locking clip. The housing comprises a top portion, a bottom portion and opposing sidewalls defining an open space therebetween. The open space receives and carries a plug comprising a cantilevered spring with a free end and a fixed end. An internal surface of the bottom portion comprises a ramp and the housing comprises a stop surface defining a channel therebetween. The locking clip is releasably securable to the housing, and is designed to secure the plug into position within the housing.

The foregoing embodiments may include various additional features.

The housing may, for example, include an internal surface comprising a ramp and a stop surface defining a channel therebetween. The internal surface and the stop surface may be positioned in different planes. The housing may also include two or more windows for receiving a plug removal tool and the internal width of at least a portion of the open space within the housing may be tapered. Internal surfaces of housing sidewalls may comprise two or more slots. Additionally or alternatively, these internal surfaces may comprise guide rails extending longitudinally throughout the housing and oriented in a parallel relationship to one another. A spring depression member associated with the housing may be positioned to interact with the spring of the plug. The housing may further comprise a tab extending outwardly therefrom. The tab may comprise a top surface and opposing sidewalls, with the underside of the top surface comprising a downwardly facing hook. An external surface of the bottom portion of the housing may comprise a core out.

The plug protection member may exhibit various configurations and be formed integrally on the housing or the locking clip. The plug protection member may comprise opposing arms connected to a top planar surface, the arms capable of movement to reposition the top planar surface.

The locking clip may further comprise a spring retaining member comprising an angled surface positioned to overlie and retain the spring. The locking clip releasably may also include opposing flanges adapted to mate with the two or more slots positioned on the internal surfaces of the housing. Similarly, the locking clip may comprise a T-shaped member adapted to ride over the upper guide rails of the housing.

BRIEF DESCRIPTION OF THE DRAWINGS

Certain embodiments of the present invention are illustrated by the accompanying figures. It should be understood that the figures are not necessarily to scale and that details not necessary for an understanding of the invention or that render other details difficult to perceive may be omitted. It should also be understood, of course, that the invention is not necessarily limited to the particular embodiments illustrated herein.

DETAILED DESCRIPTION

Referring now to FIGS. 1A-2C, one embodiment of the plug locking assembly 110 of the present invention is shown. Locking assembly 110 comprises housing 114 and pre-assembled locking clip 116.

Figure 1A:
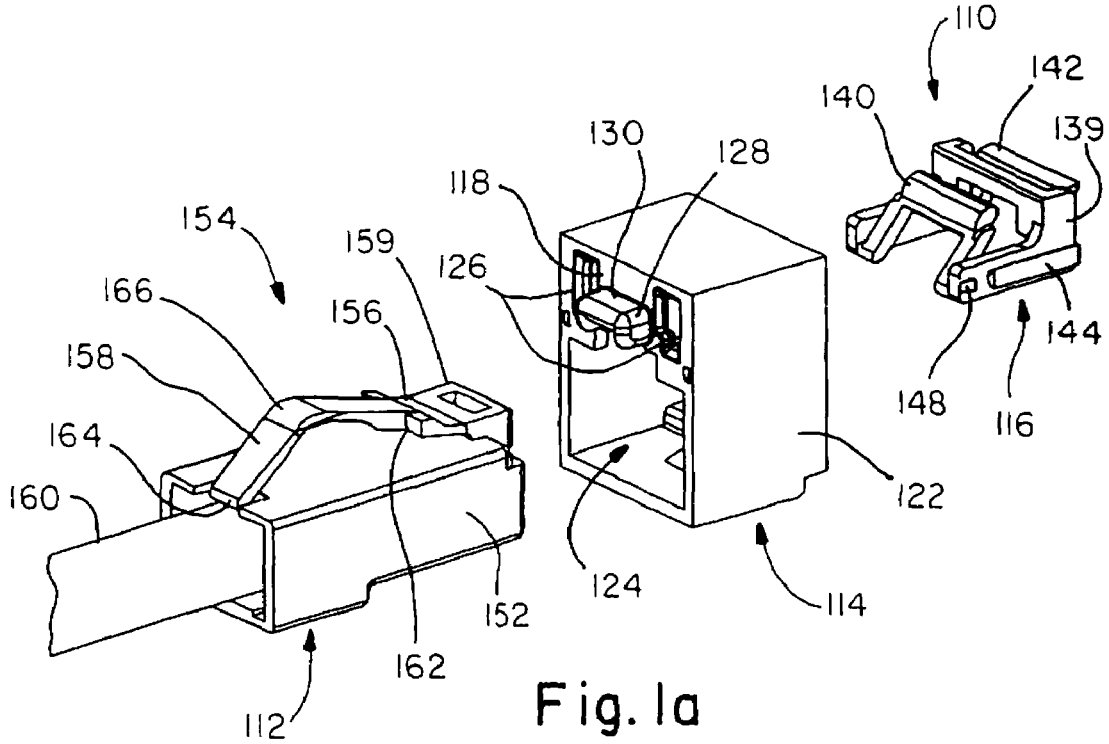
FIG. 1A is a real exploded perspective view of a plug and the plug locking assembly of the present invention.
Figure 1B:
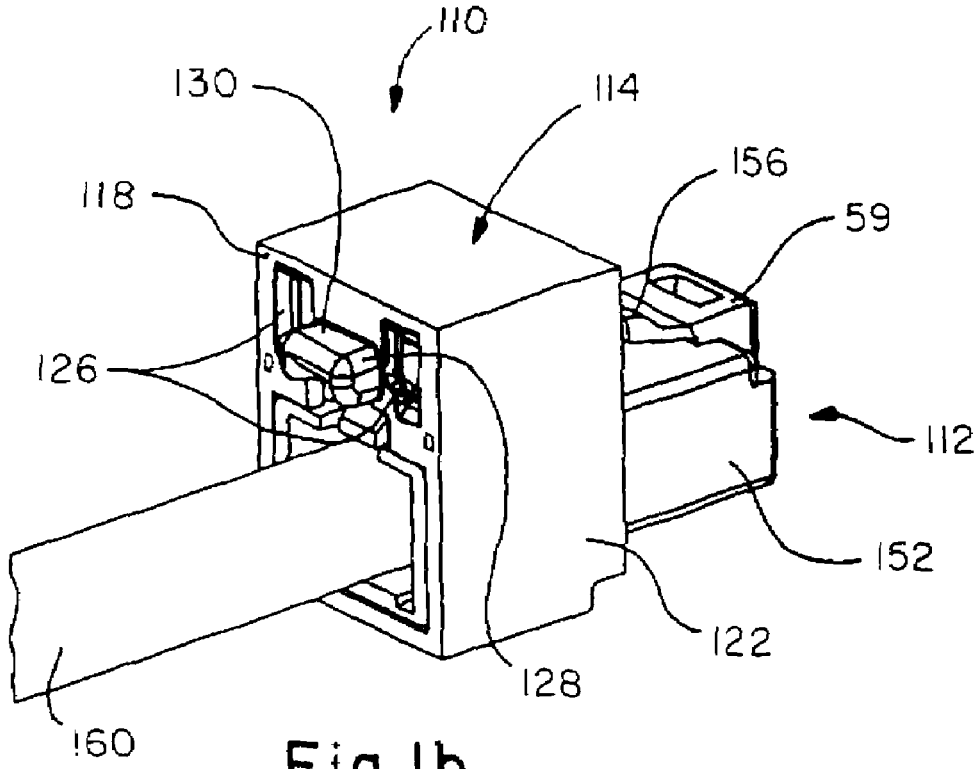
FIG. 1B is a rear assembled perspective view of FIG. 1A.
Figure 3:
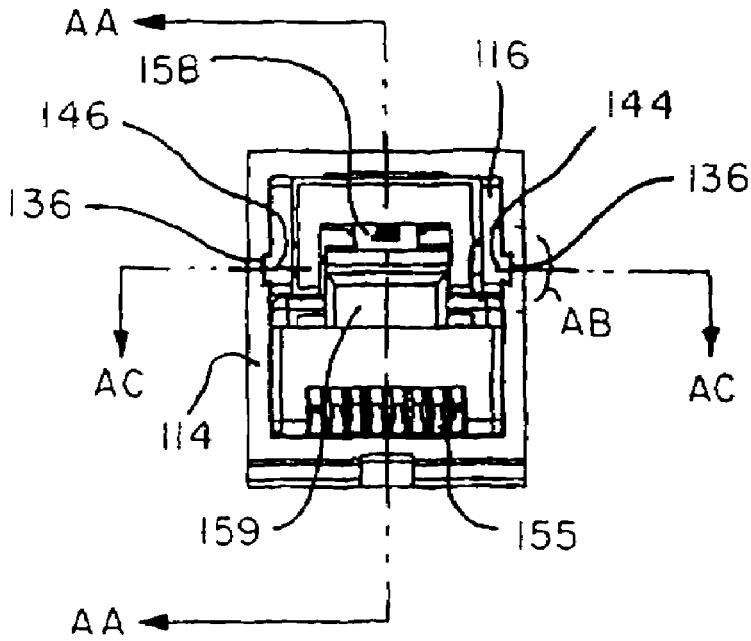
FIG. 3 is an end elevational view of FIG. 2C.
Figure 4:
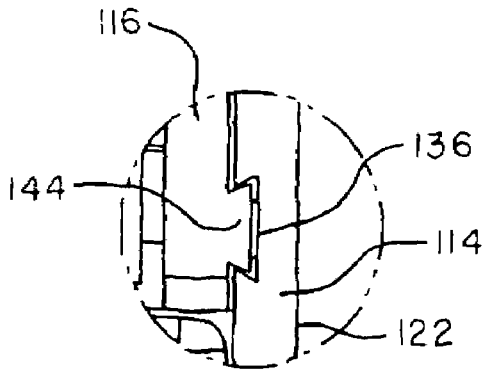
FIG. 4 is an enlarged view of detail AB of FIG. 3.
Figure 10:
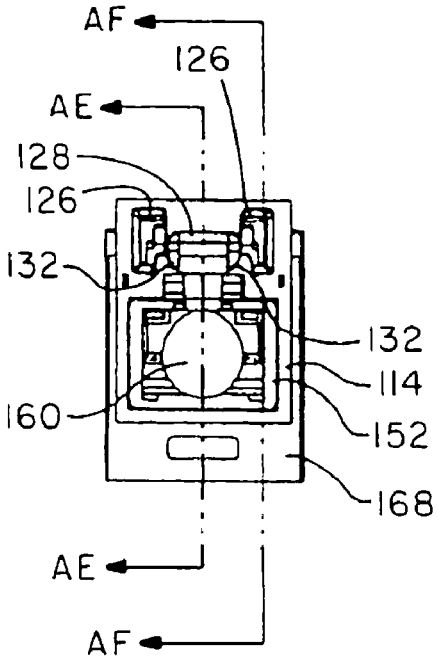
FIG. 10 is an end elevational view of FIG. 8.
Figure 11A:
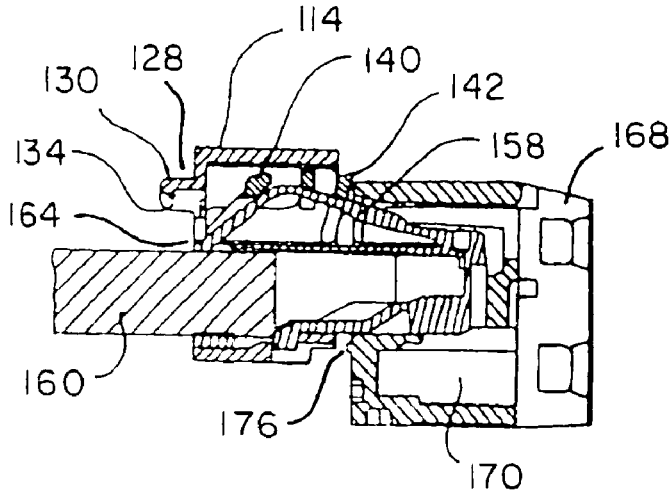
FIG. 11A is a cross-sectional view along line AE-AE of FIG. 10.
Figure 11B:
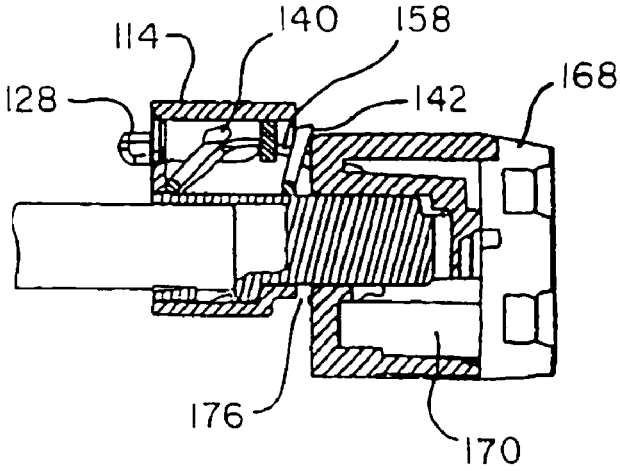
FIG. 11B is a cross-sectional view along line AF-AF of FIG. 10.

Housing 114 comprises front 118, rear 120 and sidewalls 122, defining open space or center 124 therebetween for receiving plug 112. Front 118 may include two or more access windows 126 which, as shown in FIGS. 1A and 1B, exhibit a rectangular shape. It is likewise contemplated that windows 126 may be formed from various other shapes. Front 118 may further include tab 128, integrally formed with housing 114. Tab 128 comprises top portion 130, sidewalls 132 and downwardly facing hook 134, showing in FIGS. 10 and 11A. Internal portions of sidewalls 122 of housing 114 may comprise longitudinal grooves 136, as seen in FIGS. 3 and 4. Housing 114 is typically dimensioned such that at least a portion of plug 112 extends beyond open center 124, with plug 112 engaged within housing 114, as seen in FIG. 1B. Housing 114 may further comprise core out 137 and shoulder 138, best seen in FIGS. 6 and 7.

Figure 2A:
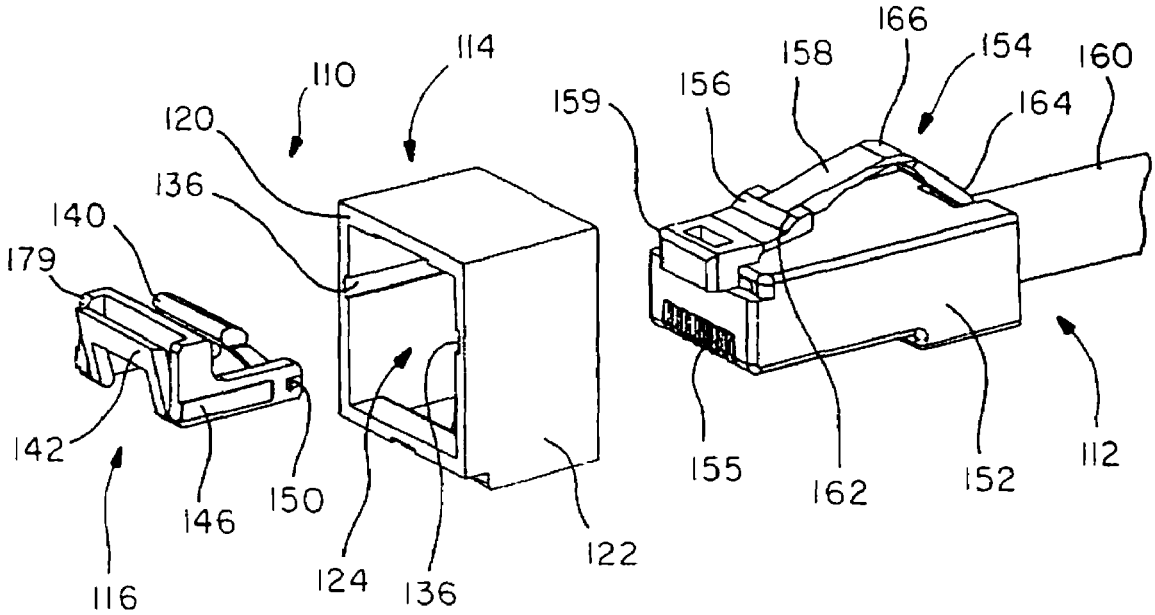
FIG. 2A is a front exploded perspective view of a plug and the plug locking assembly of the present invention.

As seen in FIGS. 1A and 2A, locking a clip 116 comprises central body 139, spring retaining member 140, plug protection member 142, opposing flanges 144 and 146 and bosses 148 and 150. Both spring retaining member 140 and plug protection member 142 may exhibit inverted U-shaped configurations and may directly or indirectly connect to the housing. Although spring retaining member 140 and plug protection member 142 are formed on locking clip 116, they may, in alternate embodiments, be formed integrally with housing 114. Spring retaining member 140 is adapted to receive and hold a portion of plug 112, while plug protection member 142 is positioned to overlie at least a portion of plug 112 after installation within housing 114.

Plug 112 may comprise housing 152, latch arm assembly 154 and electrical contacts 155. Housing 152 receives and retains wire 160. Latch arm assembly 154 comprises latch 156, cantilevered spring 158 and nose portion 159, as seen in FIGS. 1A and 2A. Spring 158 is constructed of a flexible material and comprises fixed end 162 and free end 164. Spring 158 may further comprise bent portion 166.

Figure 12:
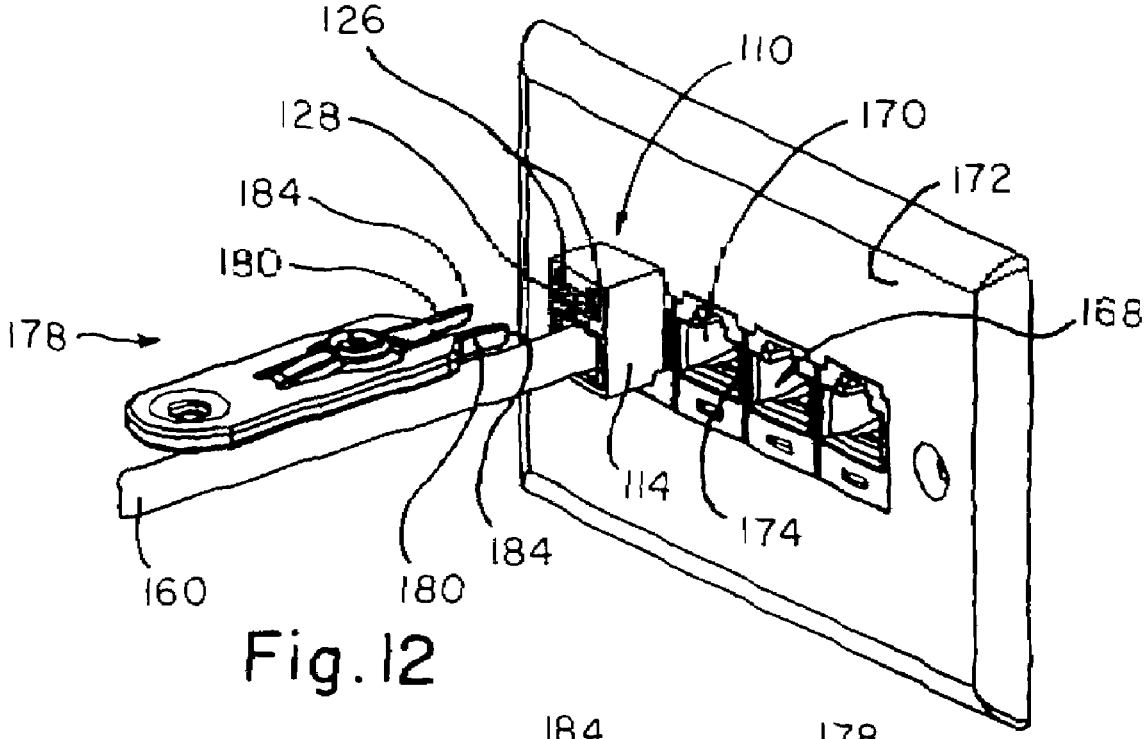
FIG. 12 is a top perspective view of FIG. 8, with a removal tool positioned to engage the housing of the plug locking assembly.
Figure 13:
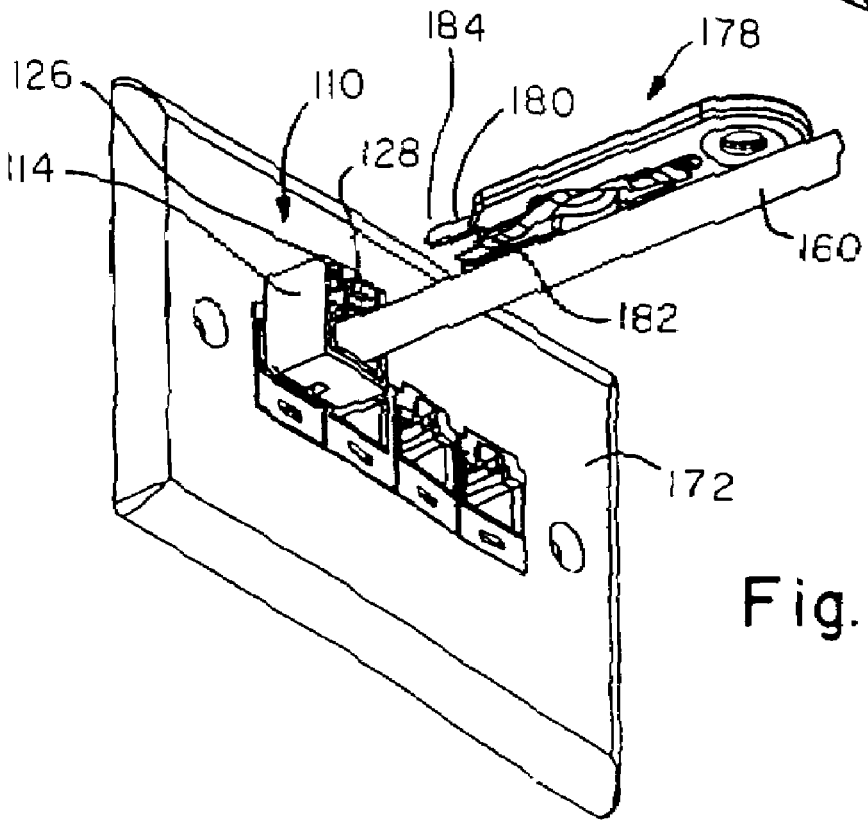
FIG. 13 is a bottom perspective view of FIG. 12, with the removal tool positioned to engage the housing of the plug locking assembly.

In operation, locking assembly 110 is used to secure and lock plug 112 into position within jack 168. Locking assembly 110 helps prevent tampering with and unintended removal of plug 112 from jack 168, as seen in FIG. 12. A user typically secures plug 112 within locking assembly 110, followed by insertion of plug 112 into jack 168.

Figure 2B:
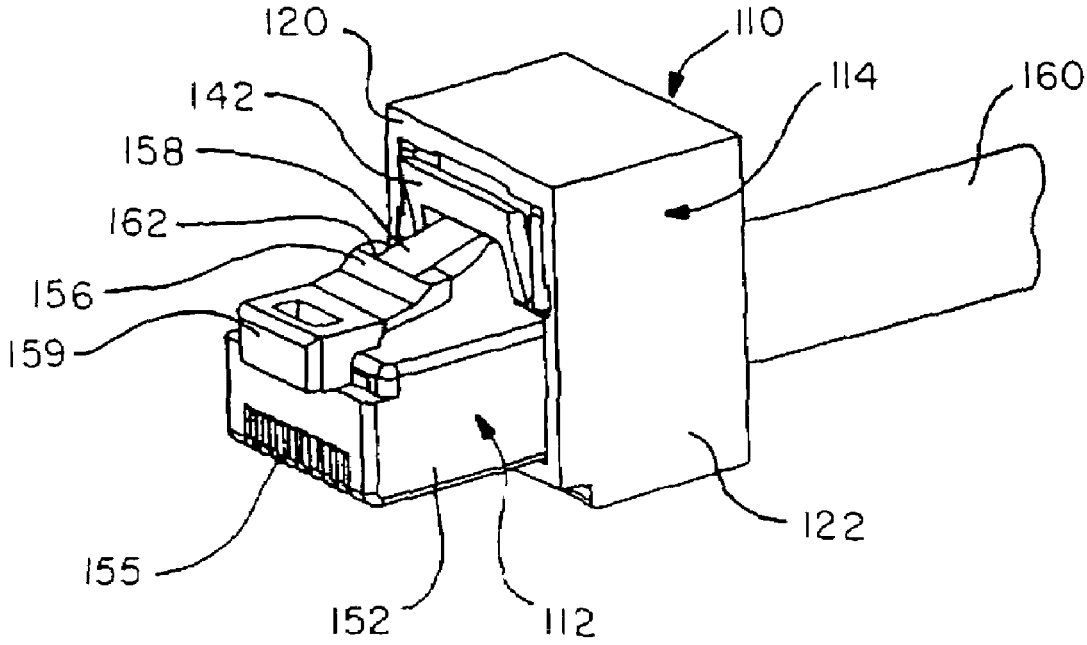
FIG. 2B is a front assembled perspective view of FIG. 2A.
Figure 2C:
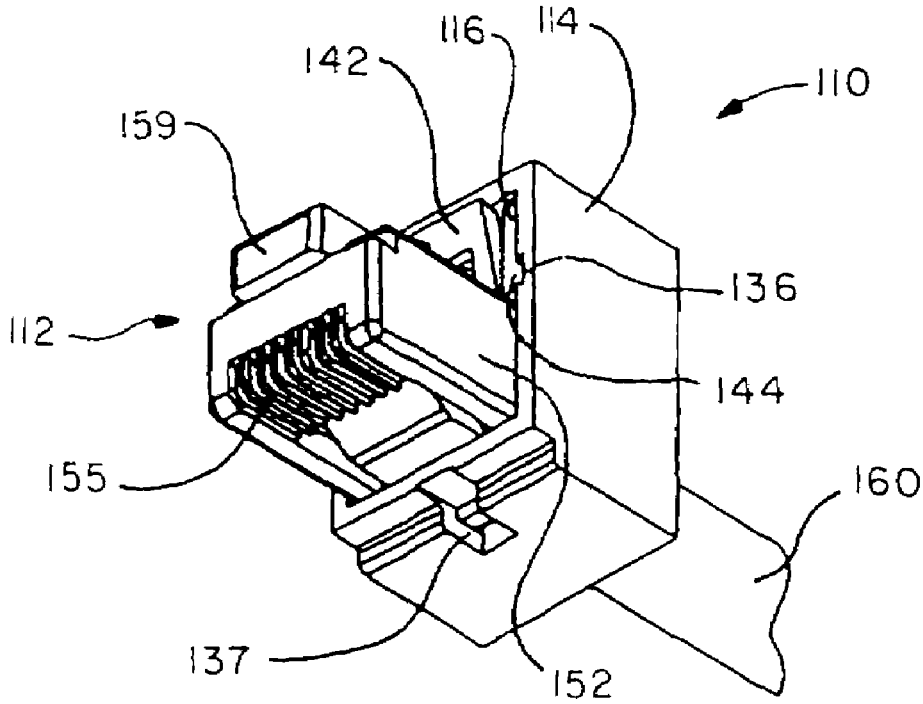
FIG. 2C is a bottom perspective view of FIG. 2B.
Figure 5:
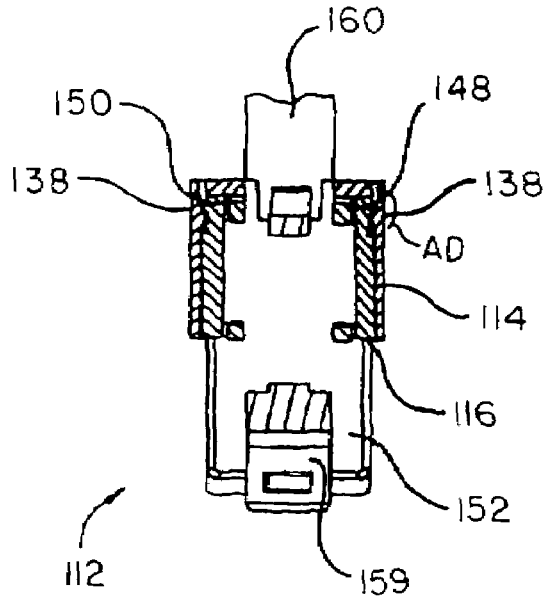
FIG. 5 is a cross-sectional view along line AC-AC of FIG. 3.
Figure 6:
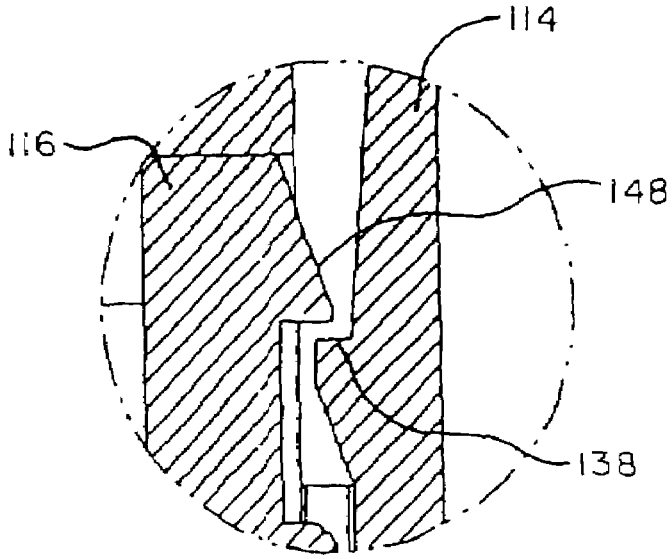
FIG. 6 is an enlarged view of detail AD of FIG. 5.
Figure 7:
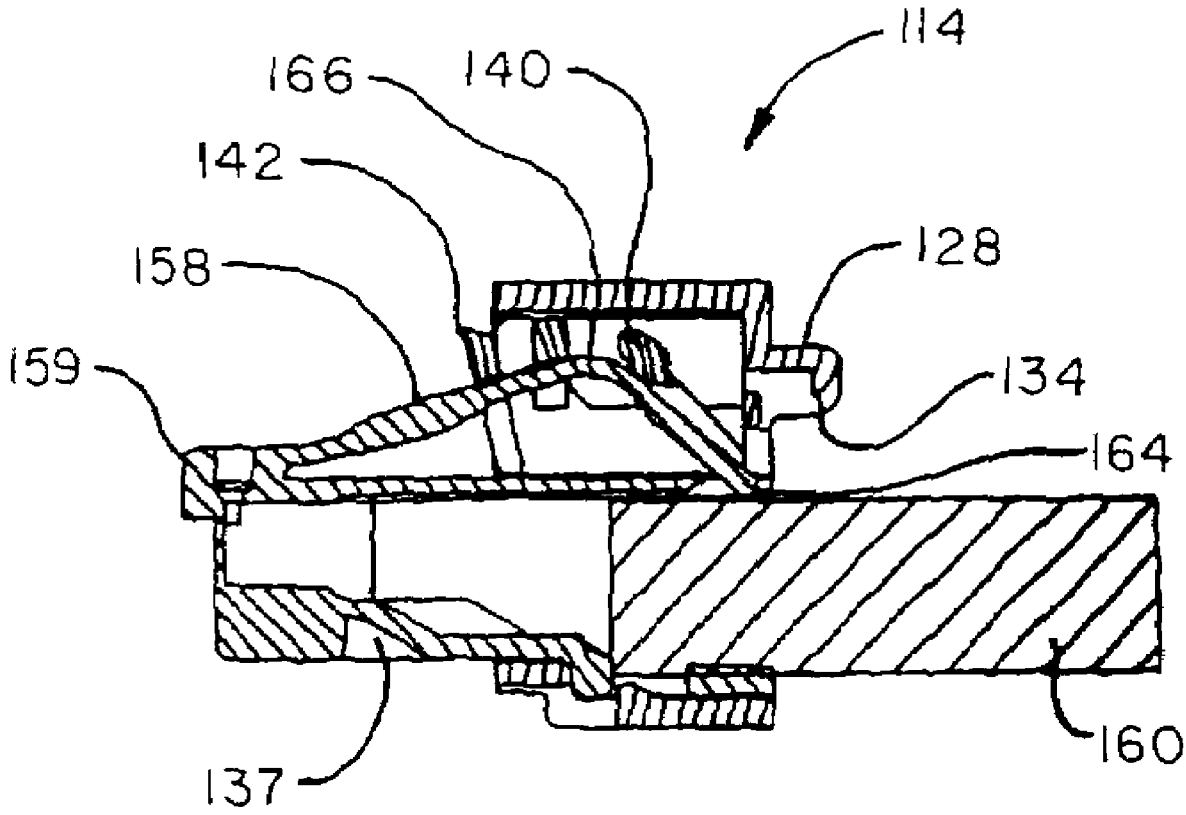
FIG. 7 is a cross-sectional view along line AA-AA of FIG. 3.

FIGS. 1B, 2B and 2C show locking assembly 110 and plug 112 in an assembled state. With locking clip 116 positioned within housing 114, opposing flanges 144 and 146 engage longitudinal grooves 136, thereby helping secure locking clip 116 into position. This tongue and groove arrangement is shown in FIGS. 3 and 4. Additionally, opposing bosses 148 and 150 ride over and engage shoulders 138 positioned within housing 114, as shown in FIGS. 5 and 6. With opposing bosses 148 and 150 engaged with shoulders 138, locking clip 116 and housing 114 become very difficult to separate without damaging locking assembly 110. Once locking clip 116 is engaged with housing 114, plug 112 may be inserted into open center 124. During insertion, tab 128 or spring retaining member 140 can act as a spring depression member to ride over and depress cantilevered spring 158, eventually allowing cantilevered spring 158 to spring back into position. Once insertion is complete, a portion of latch arm 154, as well as plug protection member 142, extend beyond rear 120 of housing 114, as shown in FIGS. 2B, 2C and 7.

With locking assembly 110 securely in position, plug 112 may be inserted into jack 168. FIGS. 8-11B illustrate insertion of plug 112 into T-shaped opening 170 within jack housing 172. As is known, a snap-fit engagement secures plug 112 within jack 168 and creates a connection between electrical contacts 155 of plug 112 and electrical contacts 174 of jack 168. During insertion, latch arm 154 depresses slightly and then snaps back into place, thereby securing latch 156 against top internal surface of jack opening 170.

Figure 9:
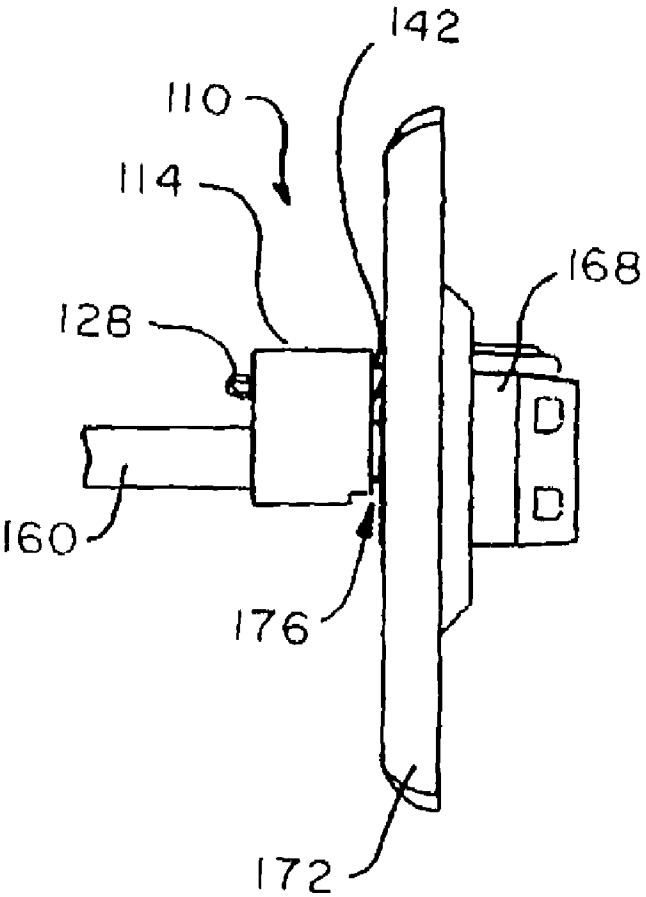
FIG. 9 is a side elevational view of FIG. 8.
Figure 8:
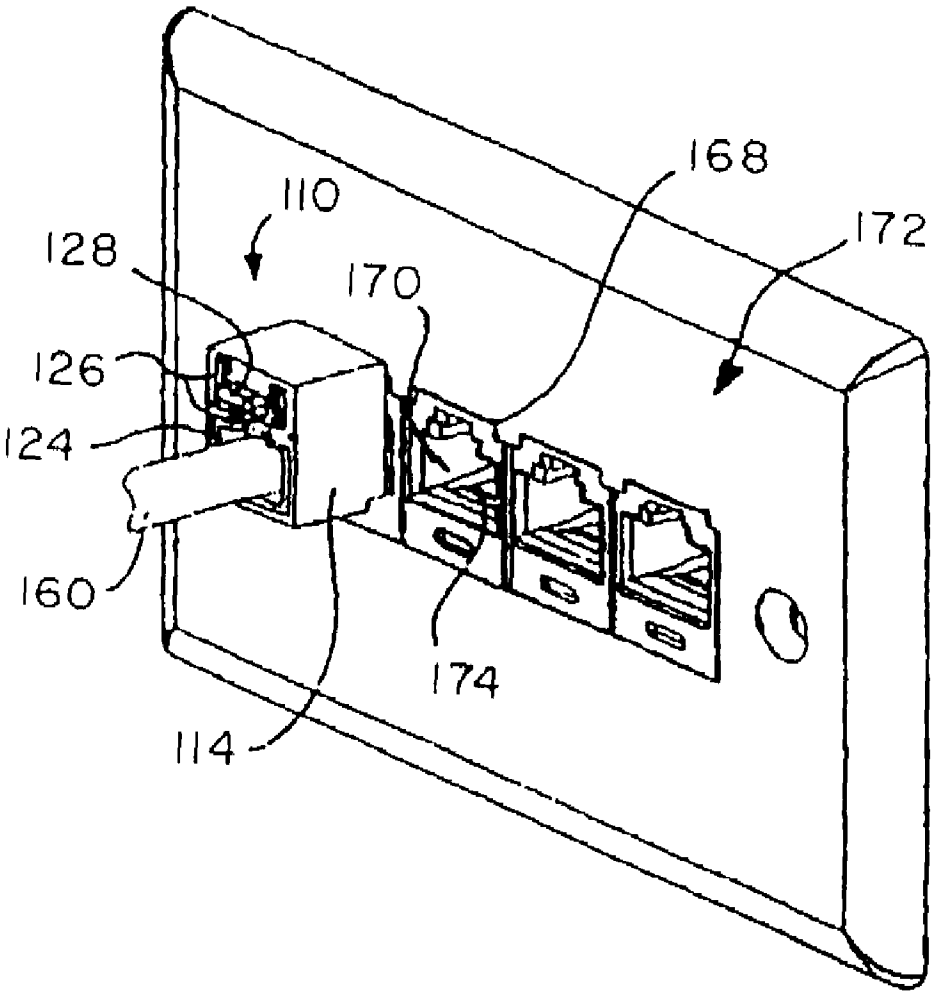
FIG. 8 is a top perspective view of the plug locking assembly engaging a plug positioned within a jack.

After insertion, a narrow gap 176 between rear 120 of housing 114 and a front surface of jack housing 172 exists, as seen in FIG. 9. To prevent unwanted access to latch arm 154 through gap 176, as seen in FIG. 2A, top surface 179 of plug protection member 142 is advantageously positioned to shield latch arm assembly 154 by occupying at least a portion of gap 176—in this case that portion of cap directly above latch arm assembly 154, as shown in FIG. 9. Accordingly, locking assembly 110 helps prevent unwanted removal of plug 112 by a screwdriver or other flat tool.

Figure 14:
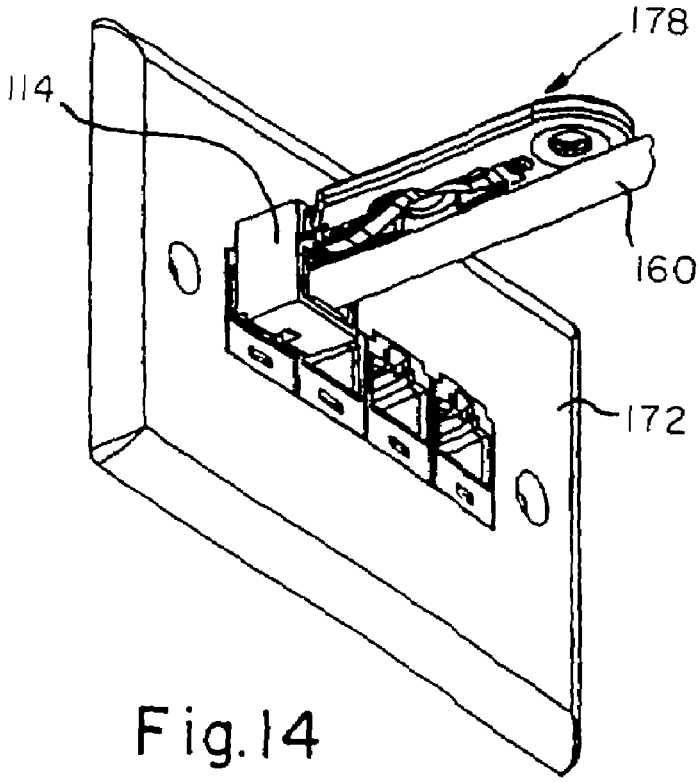
FIG. 14 is a bottom perspective view similar to FIG. 13, with the removal tool engaged with the housing of the plug locking assembly.
Figure 15:
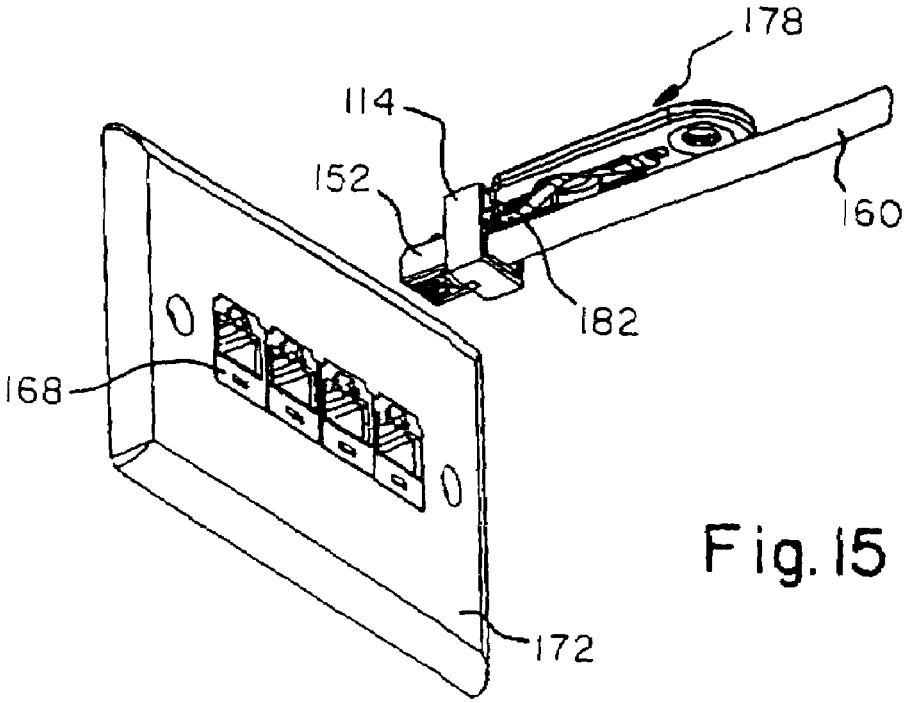
FIG. 15 is a bottom perspective view similar to FIG. 13, after the removal tool removes the plug and the plug locking assembly from the jack.
Figure 16:
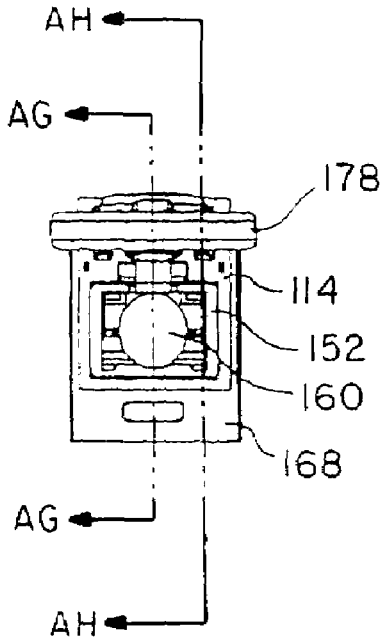
FIG. 16 is an end elevational view of FIG. 13.
Figure 17A:
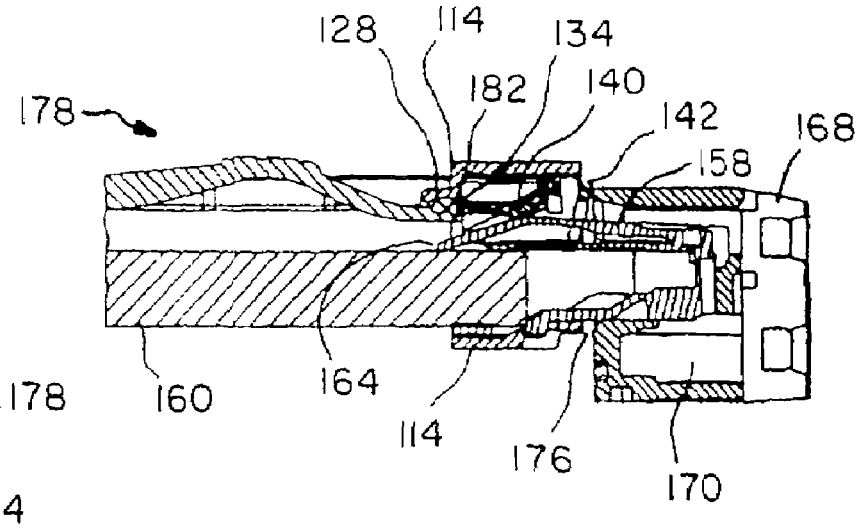
FIG. 17A is a cross-sectional view along line AG-AG of FIG. 16.
Figure 17B:
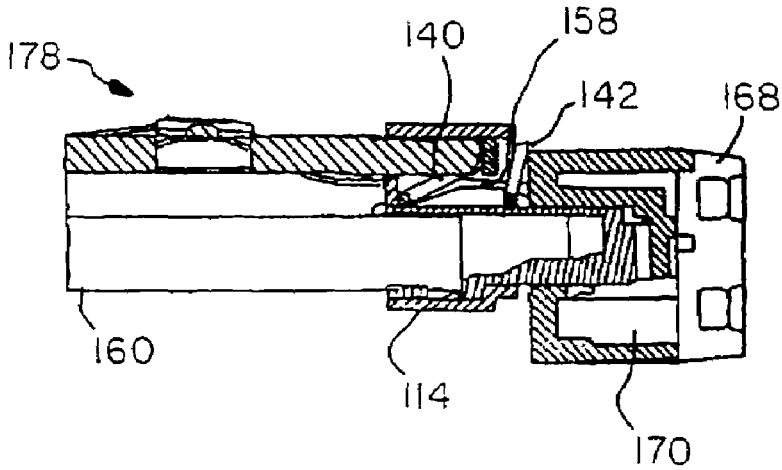
FIG. 17B is a cross-sectional view along line AH-AH of FIG. 16.

To free plug 112 from jack 168, removal tool 178 may be employed. FIGS. 12-17B illustrate use of removal tool 178 with locking assembly 110. Specifically. FIGS. 14 and 15 show removal tool 178 removing locking assembly 110 and plug 112 from jack 168. The features of removal tool are illustrated and described in co-pending, co-owned U.S. patent Ser. No. 11/207,853 filed Aug. 18, 2005, which is hereby incorporated by reference in its entirety.

Removal of plug 112 from jack 168 can be accomplished by positioning removal tool 178 such that prongs 180 are aligned with opposing access windows 126 of housing 114 and hook 182 is aligned with downwardly facing hook 134 of tab 128. As prongs 180 are inserted through access windows 126, distal ends 184 of prongs 180 contact and exert a force on spring retaining member 140 depressing latch arm assembly 154 and freeing latch 156 from jack opening 170. As a result, latch 156 no longer engages a top internal surface of jack opening 170. At the same time, hook 182 engages underside of tab 128. At this point, plug 112 can now be removed from the jack opening 170, as seen in FIG. 15. The use of tool 178 to disconnect plug 112 from jack 168 can be particularly useful in congested areas where it may otherwise be difficult to access plug 112 by hand.

Figure 18:
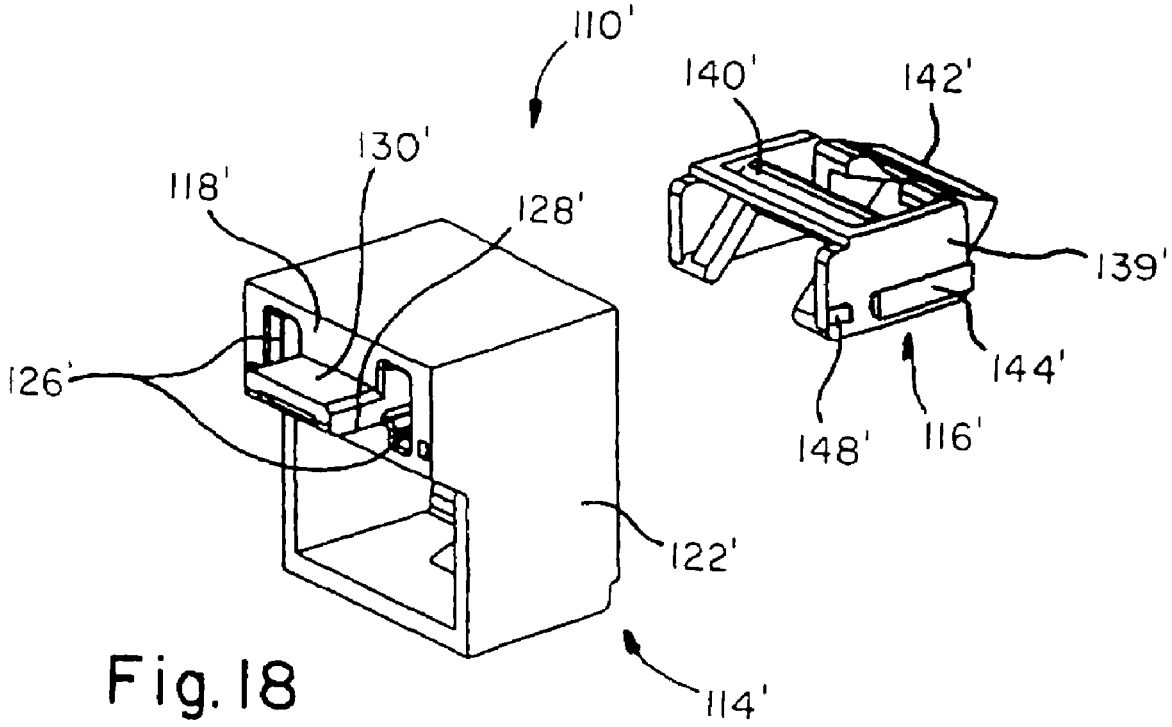
FIG. 18 is a rear exploded perspective view of a plug locking assembly according to another embodiment of the present invention.
Figure 19:
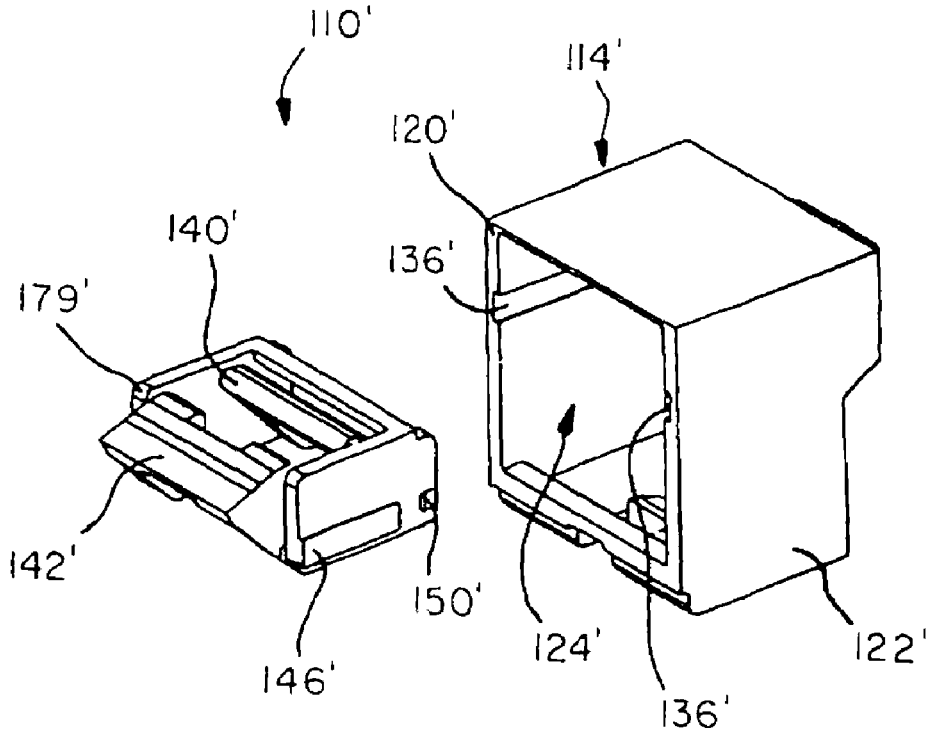
FIG. 19 is a front exploded perspective view of the plug locking assembly of FIG. 18.

FIGS. 18 and 19 illustrate another embodiment of plug locking assembly 110'. Since locking assembly 110' functions similarly to plug locking assembly 110, the same reference numerals will be used with the addition of the prime (') notation. Locking clip 116' of this embodiment includes angled plug protection member 142', which may occupy a larger gap than plug protection member 142.

Figure 20A:
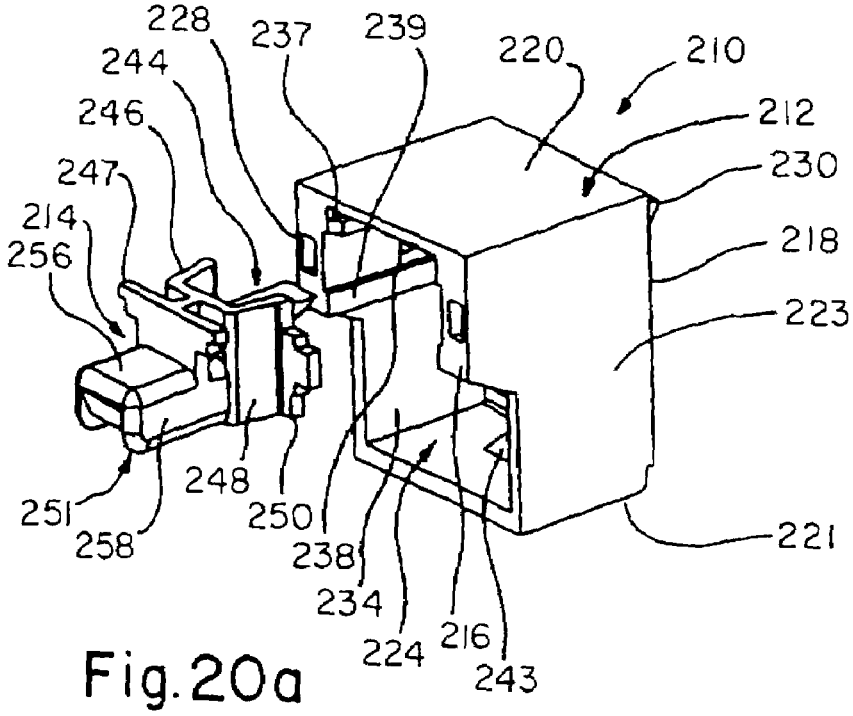
FIG. 20A is a front exploded perspective view of yet another embodiment of the plug locking assembly of the present invention.
Figure 20B:
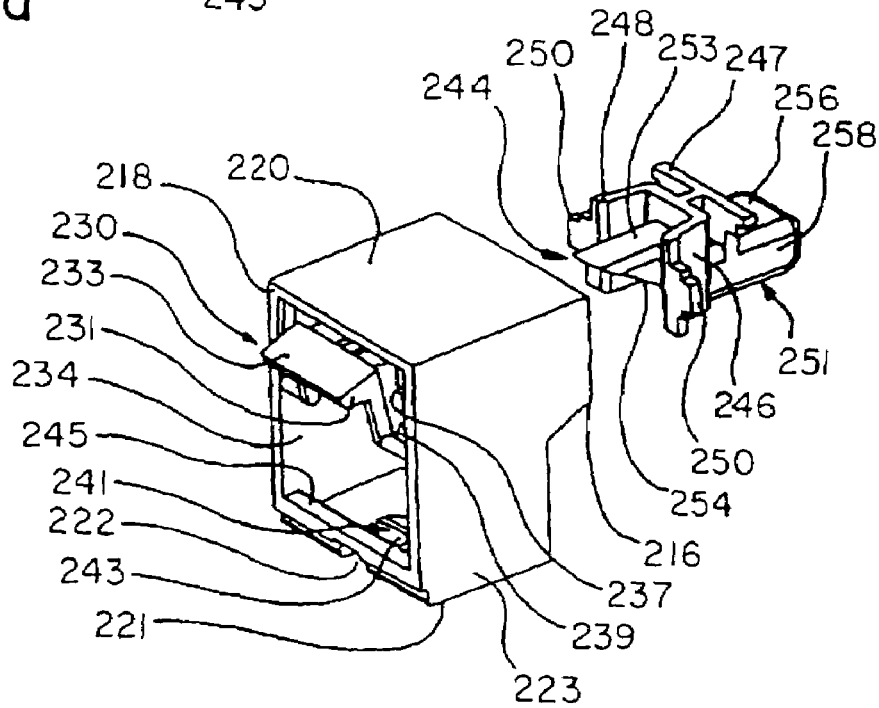
FIG. 20B is a rear perspective view of FIG. 20A.

Yet another embodiment of the present invention is illustrated by FIGS. 20A-36. Referring now to FIGS. 20A and 20B, plug locking assembly 210 of this embodiment is shown. Locking assembly 210 comprises housing 212 and pre-assembled locking clip 214.

Housing 210 comprises front 216, rear 218, top 220, bottom 221 and sidewalls 223, defining open space or center 224 therebetween for receiving plug 226. Housing 212 is typically dimensioned such that at least a portion of plug 226 extends beyond open center 224, with plug 226 engaged within housing 212. Front 216 may include two or more access windows 228, as shown in FIG. 20A. Rear 218 may comprise plug protection member 230, which may be integrally formed with housing 212 and positioned to overlie at least a portion of plug 226 after installation in housing 212. Plug protection member 230 may exhibit an inverted U-shaped configuration. As shown in FIG. 20B, plug protection member 230 comprises opposing arms 231 and top planar surface 233. Sidewalls 223 of housing 212 comprise internal surfaces 234. Internal surfaces 234 may comprise opposing slots 238 and guides comprising upper guide rails 237 and lower guide rails 239, as seen in FIGS. 20A and 20B. Upper and lower guides rails 237 and 239 may extend longitudinally throughout housing 212 and be oriented in a parallel relationship to one another. Housing 212 may further comprise channel 241, defined by ramp 243 and front stop surface 245. An internal surface of bottom 221 and stop surface 245 may be positioned in different planes.

Locking clip 214 may comprise spring retaining member 244, flexible opposing arms 246 and 248 leading into opposing flanges 250, T-shaped member 247 and tab 251. Spring retaining member 244, which may exhibit a triangular cross-section, comprises top surface 253 and ramp 254. As shown in FIGS. 20A and 20B, opposing flanges 250 may be T-shaped. Tab 251, integrally formed with locking clip 214, may comprise top portion 256, sidewalls 258 and downwardly facing hook 255, best seen in FIGS. 26 and 33. Tab 251 helps prevent unintended access to plug 226 while positioned within locking assembly 210.

Figure 24A:
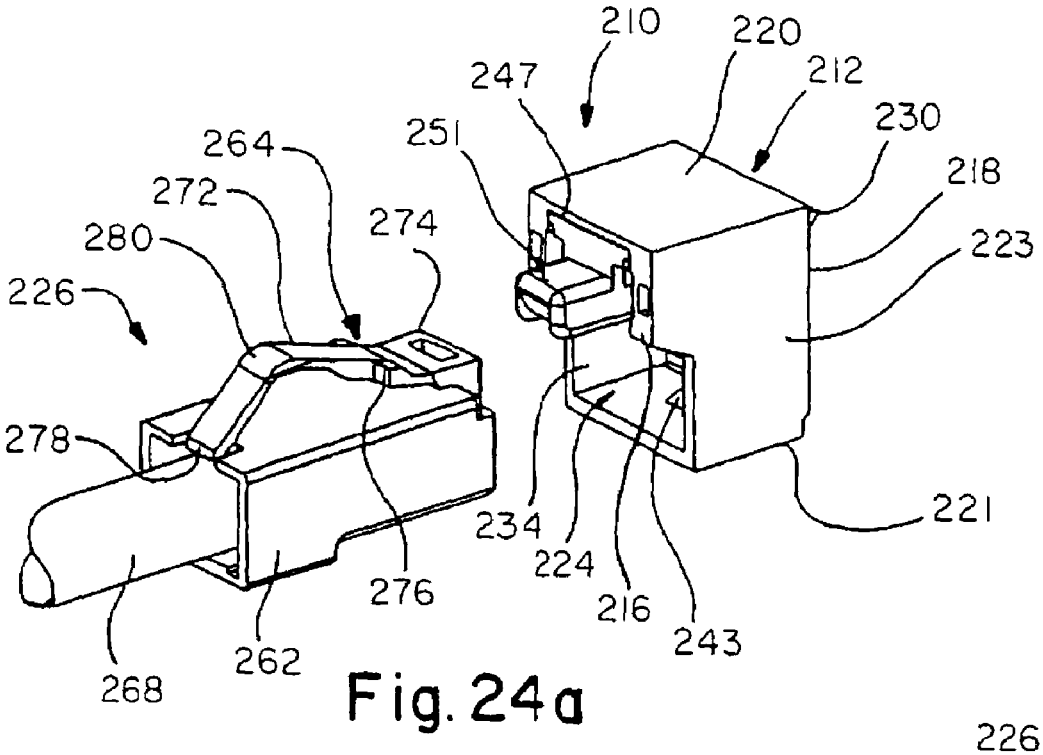
FIG. 24A is a front exploded perspective view of the plug locking assembly of FIG. 20A and a plug.
Figure 24B:
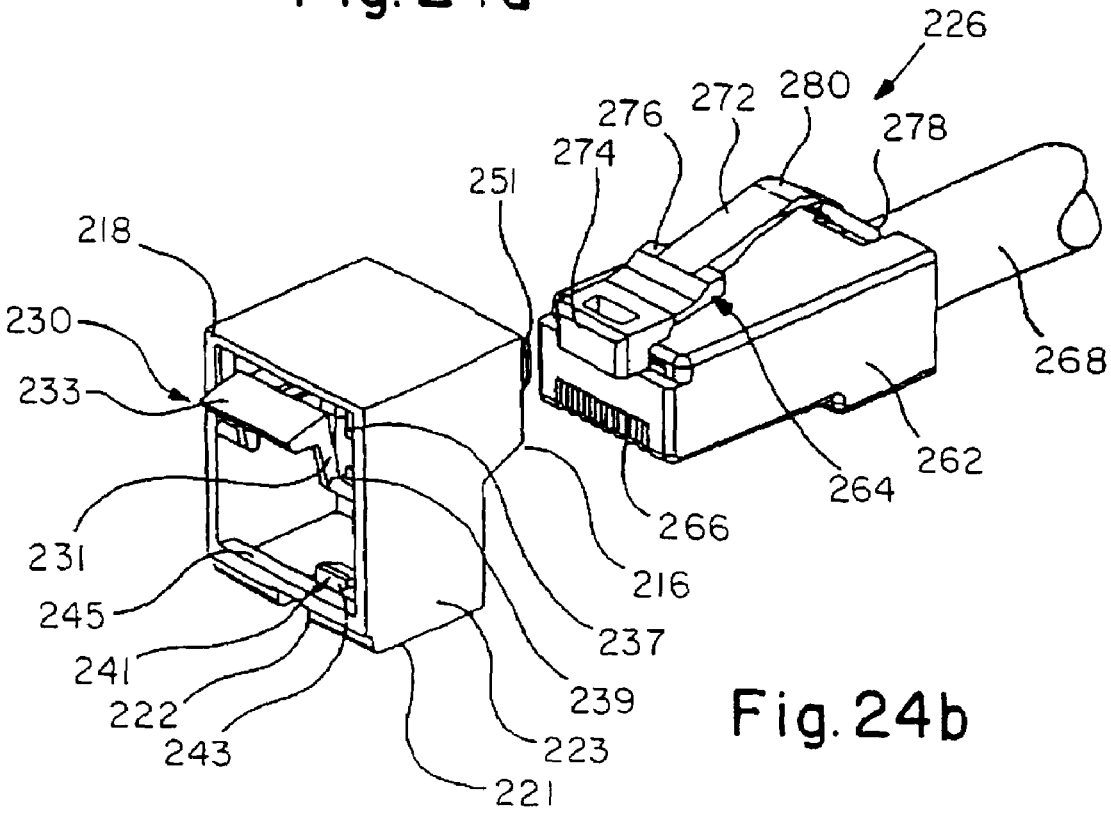
FIG. 24B is a rear perspective view of FIG. 24A.
Figure 24C:
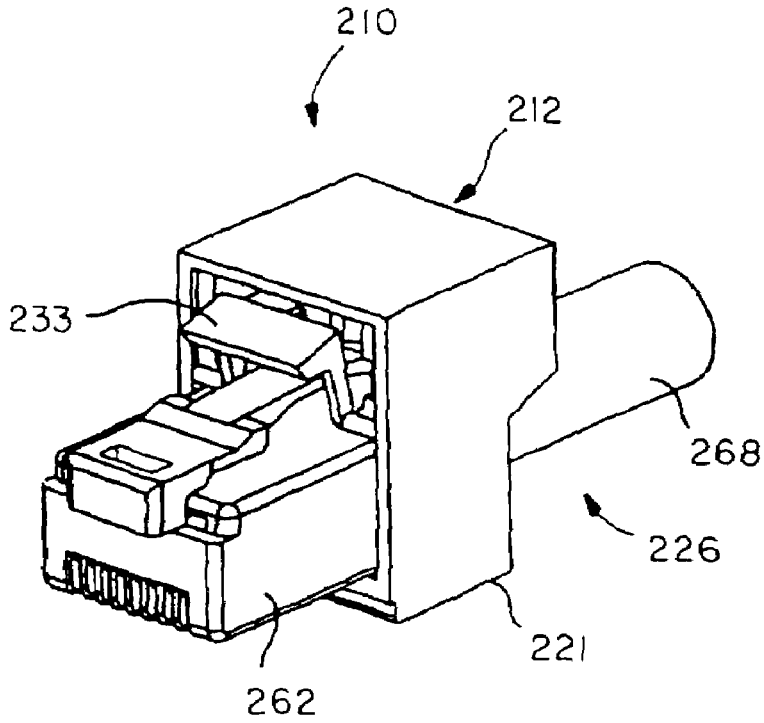
FIG. 24C is a rear perspective view similar to FIG. 24B, with a plug installed.
Figure 24D:
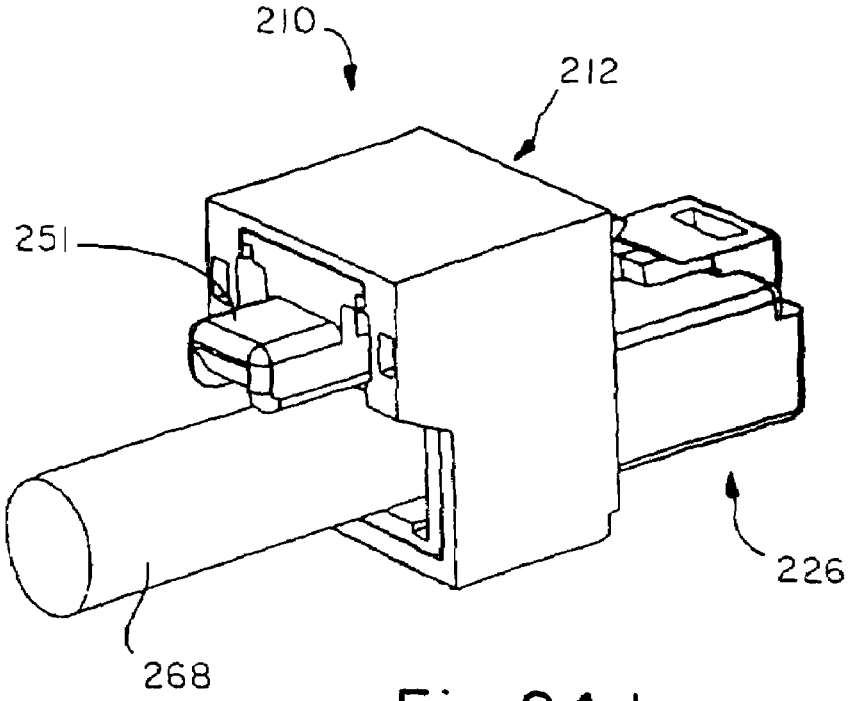
FIG. 24D is a front perspective view similar to FIG. 24A, with a plug installed.
Figure 26:
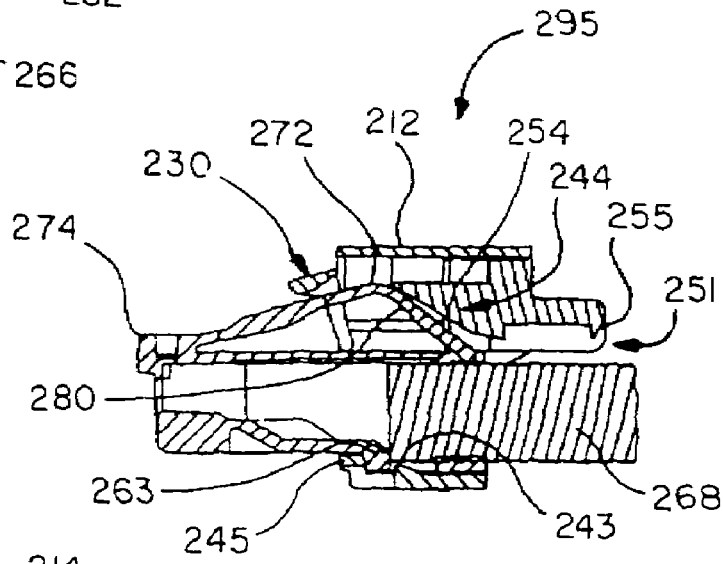
FIG. 26 is a cross-sectional view along line DD of FIG. 25.

Referring now to FIGS. 24A-B and 26, plug 226 may comprise housing 262, boss 263, latch arm assembly 264 and electrical contacts 266. Housing 262 receives and retains wire or cable 268. Latch arm assembly 264 comprises latch arm or cantilevered spring 272 and nose portion 274. Spring 272 is constructed of a flexible material and comprises fixed end 276 and free end 278. Spring 272 may further comprise bent portion 280.

Figure 28:
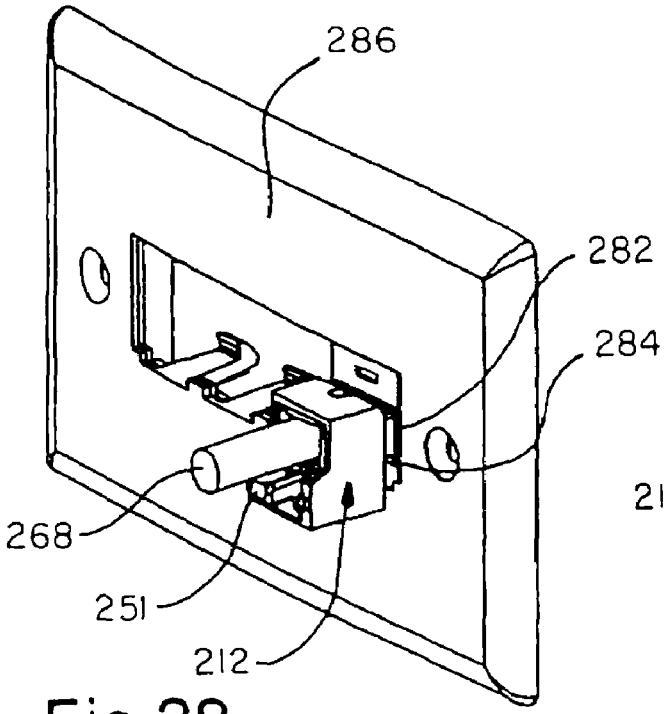
FIG. 28 is a top perspective view of the plug locking assembly of FIG. 20A, engaging a plug positioned within a jack.
Figure 29:
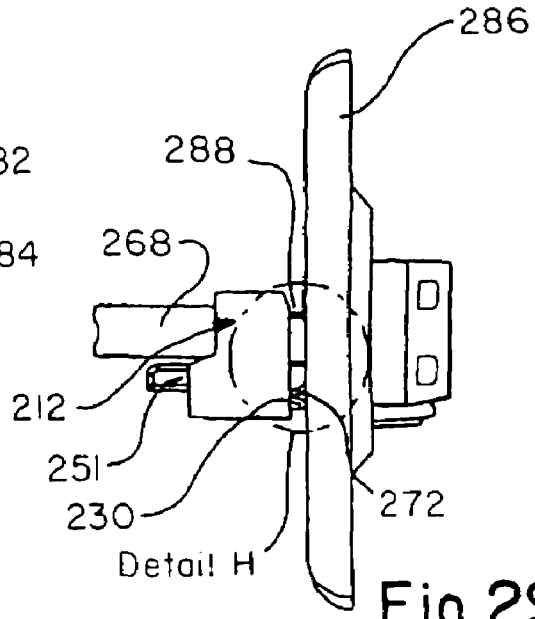
FIG. 29 is a side elevational view of FIG. 28.
Figure 30:
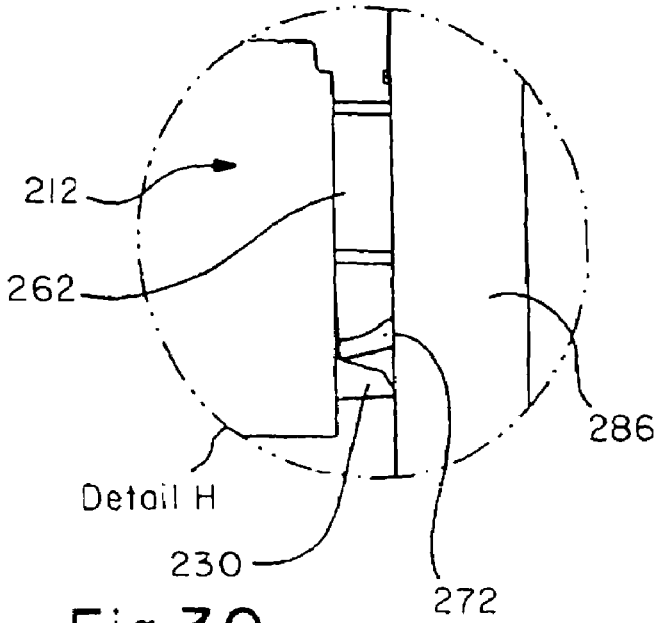
FIG. 30 is a blown up view of detail H shown in FIG. 29.

Locking assembly 210 operates similarly to the previously described embodiments. In operation, locking assembly 210 is used to secure and lock plug 226 into position within jack 282. Locking assembly 210 helps prevent tampering with and unintended removal of plug 226 from jack 282, as seen in FIGS. 28-30. A user typically secures plug 226 within locking assembly 210, followed by insertion of plug 226 into jack 282.

Figure 21:
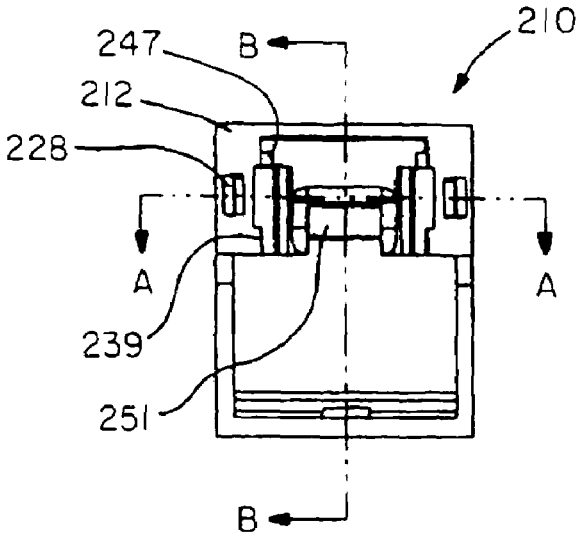
FIG. 21 is an end elevational view of FIGS. 20A and 20B, with the locking clip installed in the housing.
Figure 22:
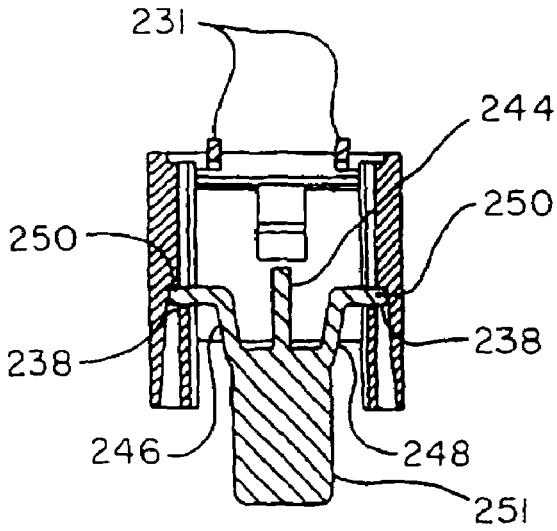
FIG. 22 is a cross-sectional view along line AA of FIG. 21.
Figure 23:
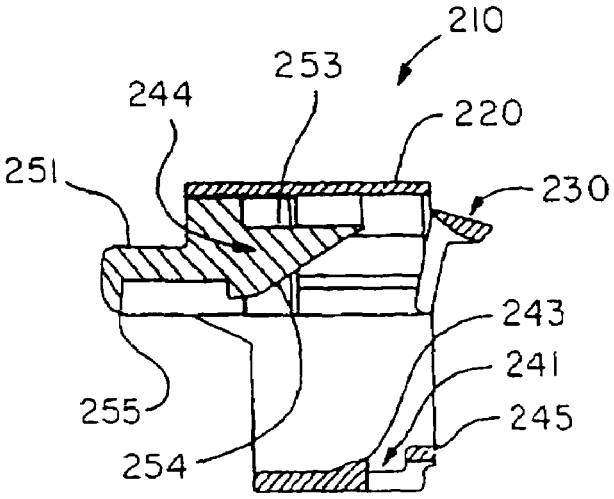
FIG. 23 is a cross-sectional view along line BB of FIG. 21.

FIGS. 21-23 show locking assembly 210 in an assembled state. With locking clip 214 positioned within housing 212, opposing flanges 250 engage slots 238, thereby helping secure locking clip 214 into position. This arrangement, shown in FIG. 22, makes it difficult to separate housing 212 from locking clip 214, without damaging locking assembly 210. To accomplish engagement, flexible opposing arms 246 and 248 may be squeezed inwardly before insertion of locking clip 214 into housing 212, thereby allowing them to spring into slots 238 during the insertion process. Alternatively, the internal width dimension of open space 224 may taper so that opposing flanges 250 of locking clip 214 spring into slots 238 during insertion. Additionally, T-shaped member 247 rides over upper guide rails 237, providing stability against rocking of locking clip 214 within housing 212.

Figure 25:
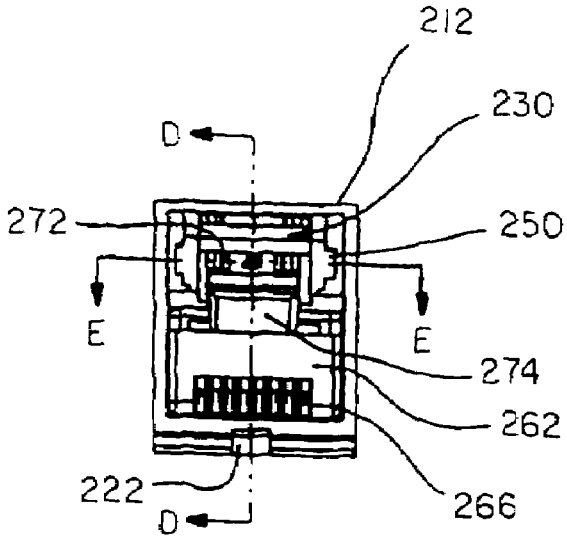
FIG. 25 is an end elevational view of FIG. 23, with a plug installed.
Figure 27:
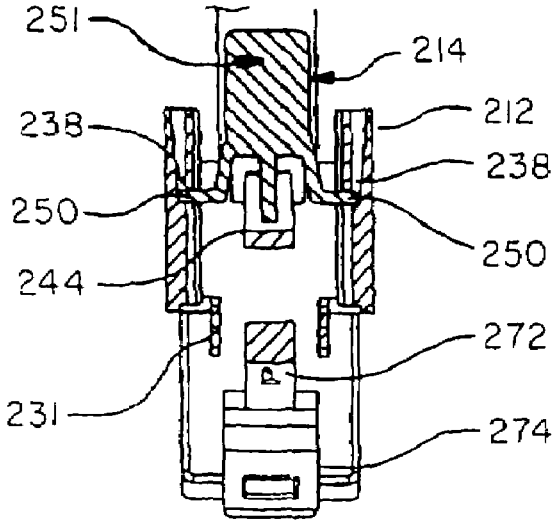
FIG. 27 is a cross-sectional view along line EE of FIG. 25.

Once locking clip 214 is engaged within housing 212, plug 226 may be inserted into open center 224. FIGS. 25-27 show plug 226 installed within locking assembly 210. During insertion, tab 251 or spring retaining member 244 can act as a spring depression member to ride over and depress cantilevered spring 272. Plug 226 is held in place by boss 263, which rests in channel 241, between ramp 243 and stop surface 245 of lousing 212. Under these circumstances, it is difficult to remove plug 226 without damaging locking assembly 210.

With plug 226 secured within locking assembly 210, plug 226 may be inserted into jack 282. FIGS. 28-30 illustrate insertion of plug 226 into opening 284 within jack housing 286. As is known, a snap-fit engagement secures plug 226 within jack 282 and creates a connection between electrical contacts 266 of plug 226 and electrical contacts (not shown) of jack 282. Plug 226 is typically inserted so that top 220 of housing 212 faces down and bottom 221 of housing 212 faces up, though the opposite orientation may be employed depending on jack orientation. During insertion, spring 272 depresses slightly and then snaps back into place, thereby securing spring 272 against a bottom internal surface of jack opening 284.

After insertion, gap 288 between rear 218 of housing 212 and a front surface of jack housing 286 exists, as seen in FIGS. 29 and 30. To prevent unwanted access to spring 272 through gap 288, top surface 233 of plug protection member 230 is advantageously positioned to shield spring 272 by occupying at least a portion of gap 288, as shown in FIG. 30. Plug protection member 230 is self-adjusting. That is, depending on the geometry of the plug-jack arrangement, plug protection member 230 may flex forward or backward (between about 0.05 inches to about 0.2 inches and more particularly about 0.1 inches) to automatically fill gap 288.

To free plug 212 from jack 282, the same removal tool used in connection with earlier embodiments may be employed. FIGS. 31-36 illustrate use of removal tool 290 with the locking assembly 210 of the present invention. FIG. 34 shows removal tool 290 removing locking assembly 210 and plug 212 from jack 282. Removal tool 290 is locked to locking assembly 210.

Figure 31:
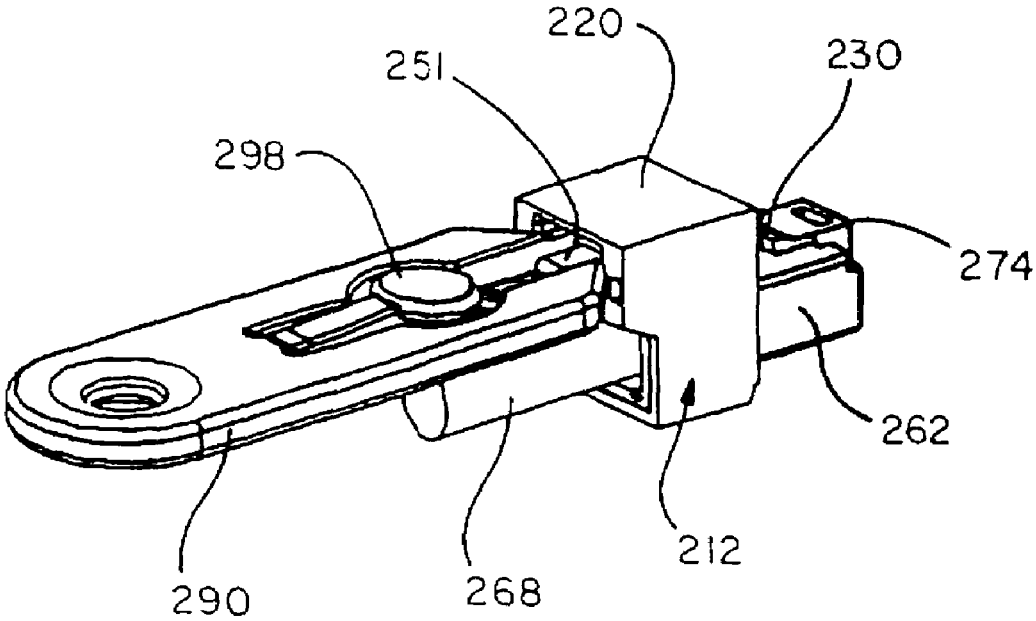
FIG. 31 is a top perspective view of FIG. 25, with a removal tool positioned to engage the locking clip of the plug locking assembly.
Figure 32:
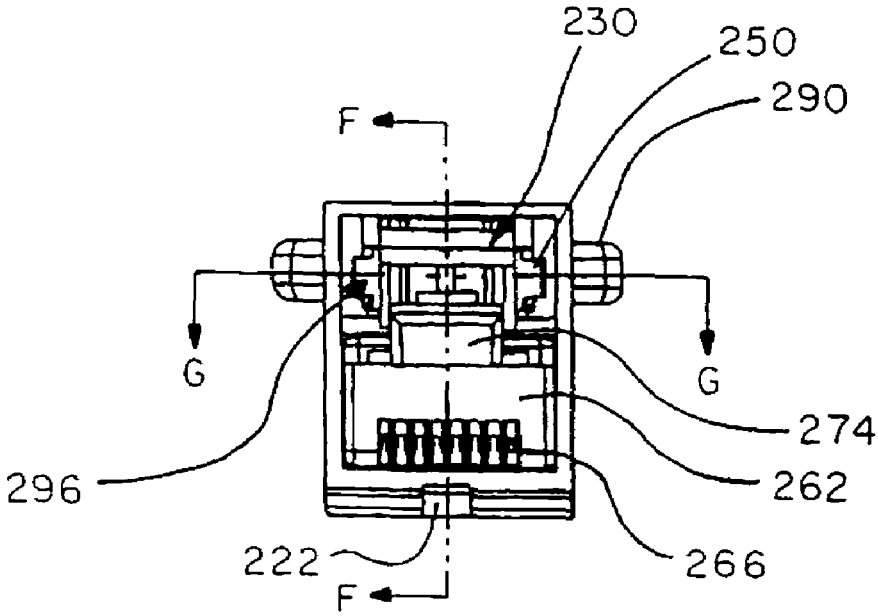
FIG. 32 is an end elevational view of FIG. 31.
Figure 33:
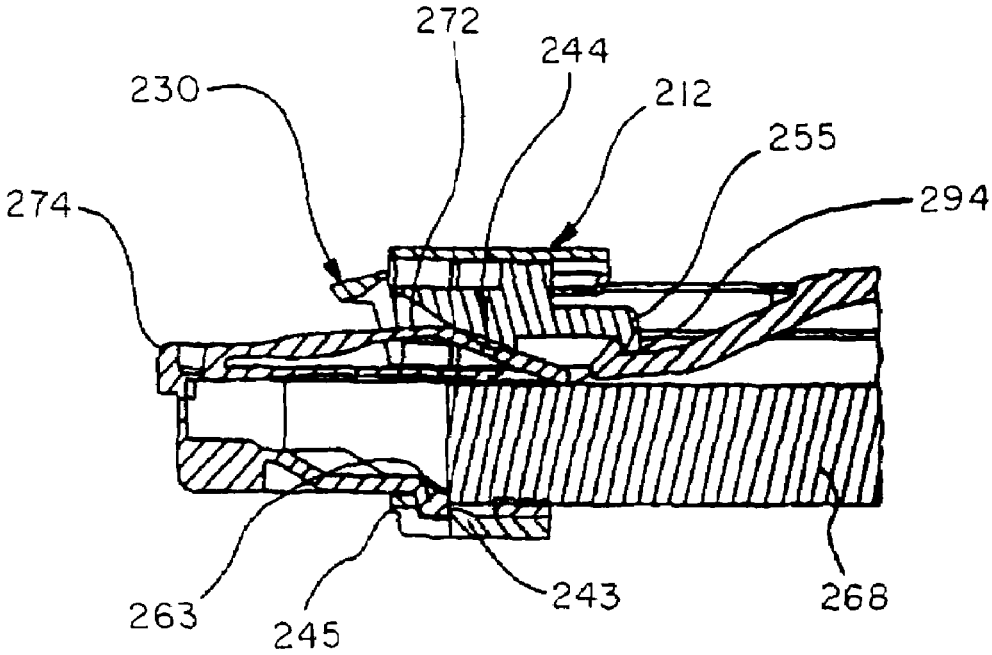
FIG. 33 is a cross-sectional view along line FF of FIG. 32.
Figure 34:
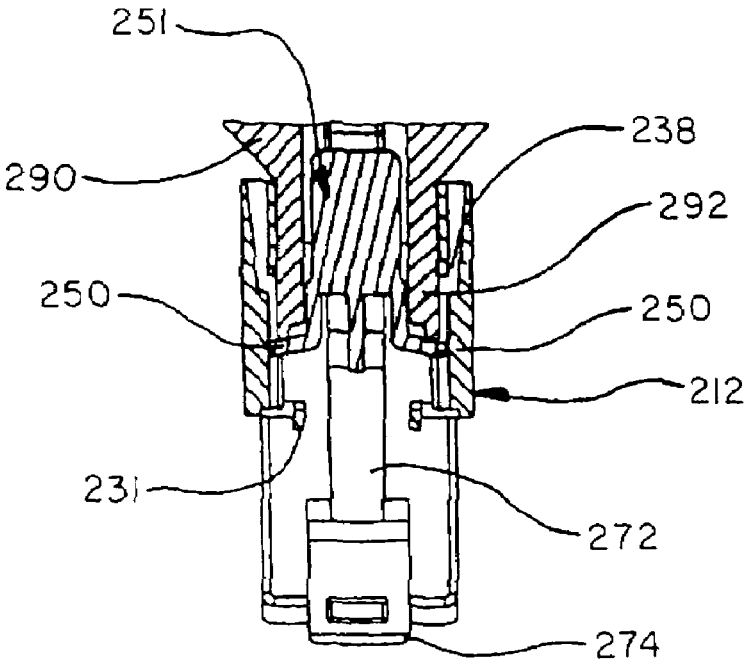
FIG. 34 is a cross-sectional view along line GG of FIG. 32.
Figure 35:
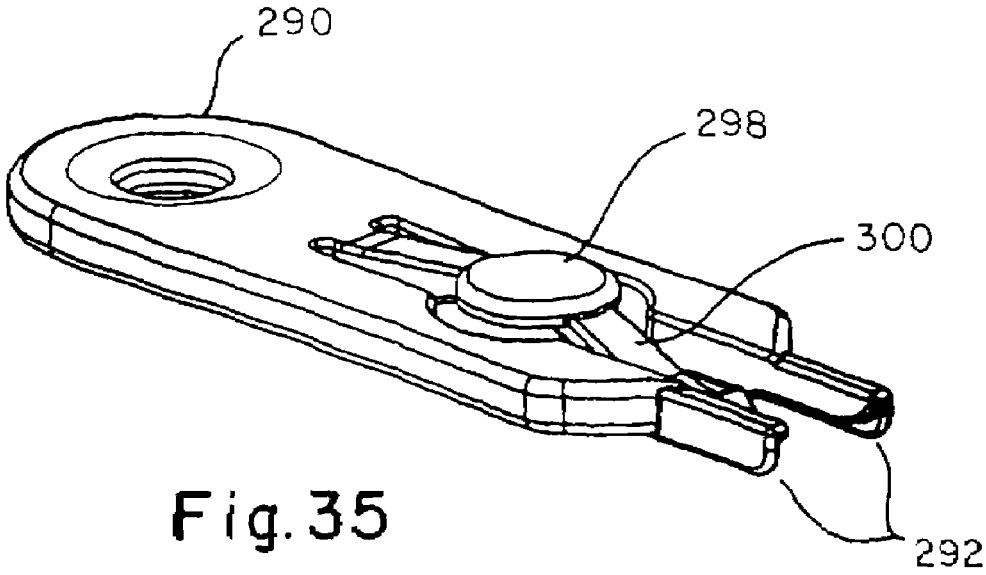
FIG. 35 is a top perspective view of the removal tool shown in FIG. 31.
Figure 36:
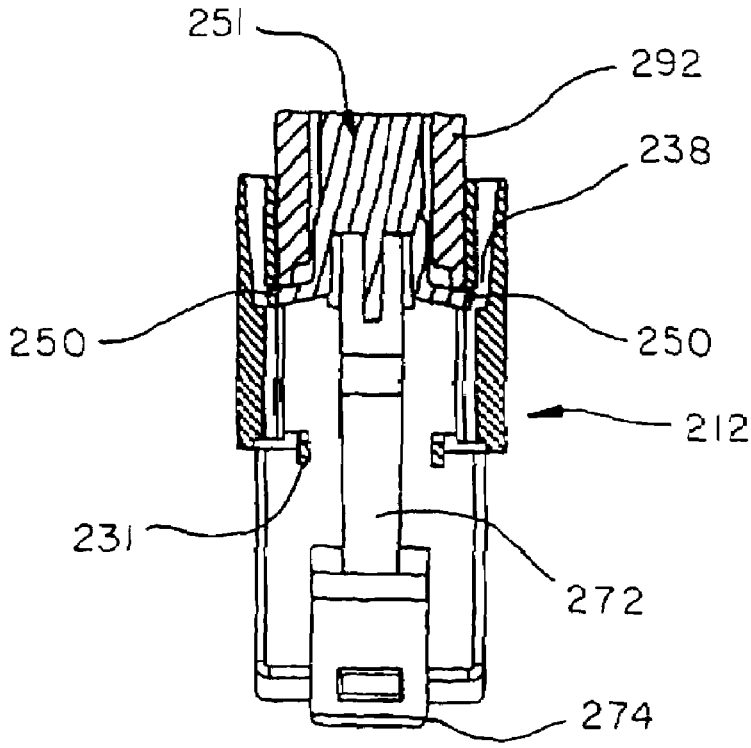
FIG. 36 is a cross-sectional view similar to FIG. 34.

Removal of plug 226 from jack 282 can be accomplished by positioning removal tool 290 such that prongs 292 may be inserted through open center 224 of housing 212 under wire or cable 268 into channels 296, while hook 294 of removal tool 290 is aligned with downwardly facing hook 255 of tab 251, as shown in FIG. 33. Removal tool 290 is oriented with release button 298 facing upward, opposite wire 268. Upper and lower guide rails 237 and 239 direct prongs 292. After insertion, prongs 292 are used to contact and exert an inward force on flexible arms 246 and 248, thereby freeing opposing flanges 250 from slots 238, as shown in FIG. 36. At this point, removal tool 290 may be used to move locking clip 204 slightly forward within housing 212, as shown in FIG. 34. As locking clip 204 moves forward, ramp 254 of spring retaining member 244 depresses spring 272 so that plug 226 can be pulled out of jack opening 284, as shown in FIG. 33. As a result, spring 272 no longer engages an internal surface of jack opening 284 and latch arm assembly 264 is released from jack 282. Plug 226, however, remains secured within locking assembly 210. Use of tool 290 to disconnect plug 226 from jack 282 can be particularly useful in congested areas where it may otherwise be difficult to access plug 226 by hand. Tool 290 is released from locking assembly 210 by depressing release button 298 after plug 226 is removed, as shown in FIG. 31.

Plug locking assembly 110, 110' or 210 may be molded as a two-piece component, with housing and locking clip created from separate molds. This type of construction eliminates the need for side actions in the mold tooling, thereby simplifying molding and increasing security by reducing the need for core outs, though core out 137, as seen in FIGS. 2C and 7, is typically formed on a bottom surface of housing.

While certain embodiments of the present invention have been shown and described, it will be obvious to those skilled in the art that changes and modifications may be made. The matter set forth in the foregoing description and accompanying drawings is offered by way of illustration only and not as a limitation. The actual scope of the invention is intended to be defined in the following claims.

The invention claimed is:

1. A plug locking assembly comprising: a housing comprising a top portion, a bottom portion and opposing sidewalls defining an open space therebetween, the open space for receiving and carrying a plug comprising a spring, the open space being dimensioned such that at least a portion of the spring extends beyond the open space with the plug engaged within the housing; a spring depression member tot riding over and depressing the spring when the plug is inserted and/or removed from the housing: and a plug protection member received within the open space of the housing and comprising a surface spaced apart from the open space and positioned to overlie at least a portion of the spring with the plug engaged within the housing.

2. The plug locking assembly of claim 1, wherein the spring depression member comprises at least one of a spring retaining member and a tab.

3. The plug locking assembly of claim 2, wherein the spring retention member comprises an angled surface to overlie and retain the spring.

4. The plug locking assembly of claim 2, wherein the spring retention member exhibits a triangular cross section and comprises a top surface and a ramp.

5. The plug locking assembly of claim 2, wherein the spring retention member exhibits an inverted U-shape configuration.

6. The plug locking assembly of claim 1, wherein at least one of the spring depression member and the plug protection member is formed on the housing.

7. The plug locking assembly of claim 1, further comprising a locking clip engageable within the open space, said locking clip for securing the plug into position within the housing.

8. The plug locking assembly of claim 7, wherein at least one of the spring depression member and the plug protection member is formed on the locking clip.

* * * * *

UNITED STATES PATENT AND TRADEMARK OFFICE

CERTIFICATE OF CORRECTION

PATENT NO. : 7,438,584 B2
APPLICATION NO. : 12/031810
DATED : October 21, 2008
INVENTOR(S) : Jack E. Caveney et al.

It is certified that error appears in the above-identified patent and that said Letters Patent is hereby corrected as shown below:

- Title Page item 75, line 2 Inventors: The period is missing in “Shaun P Brouwer”, it should read -Shaun P. Brouwer-.

- Column 1, Line 38, the word “in” should be -an-.

- Column 1, Line 42, there should be no comma after defining, it should read -defining an-.

- Column 1, Line 53, “a housings, locking clip” should read -a housing, a locking clip-.

- Column 2, Line 48, the word “real” should be -rear-.

- Column 4, Line 6, the word “showing” should be -shown-.

- Column 4, Line 14, “locking a clip” should read -locking clip-.

- Column 5, Line 7, the word “cap” should be -gap-.

- Column 6, Line 53, the word “lousing” should be -housing-.

- Column 8, Line 18, the word “tot” should be -for-.

Signed and Sealed this

Thirty-first Day of March, 2009

John Doll

JOHN DOLL
*Acting Director of the United States Patent and Trademark Office*